United States Patent [19]

Harriman

[11] 3,982,590

[45] Sept. 28, 1976

[54] WELL BORE CLEANING DEVICE

[75] Inventor: Donald W. Harriman, Duncan, Okla.

[73] Assignee: Halliburton Company, Duncan, Okla.

[22] Filed: Aug. 4, 1975

[21] Appl. No.: 601,819

[52] U.S. Cl. ..... 166/173; 166/312; 166/285

[51] Int. Cl.[2] ..... E21B 33/14; E21B 37/00

[58] Field of Search ..... 166/173, 312, 170, 172, 166/175, 285, 177, 311; 15/104.05, 104.16

[56] References Cited

UNITED STATES PATENTS

| | | | |
|---|---|---|---|
| 2,728,398 | 12/1955 | Taylor | 166/170 |
| 3,351,136 | 11/1967 | Nelson | 166/173 |
| 3,842,906 | 10/1974 | Paramore et al. | 166/172 |

*Primary Examiner*—Stephen J. Novosad
*Attorney, Agent, or Firm*—Floyd A. Gonzalez; John H. Tregoning

[57] ABSTRACT

A method and device is presented which cleans the mud filter cake from the walls of a well bore in an oil well by inducing vortex trails in a cement slurry as the slurry is pumped into the annulus between an oil well casing and the walls of the well bore. The device includes a plurality of resilient cylinders which are dimensioned to induce vortex trails in the slurry as it moves past the cylinders. The cylinders are fastened to a strap which may be wound about the exterior of the casing and clamped into place such that the cylinders are located in a random manner about the exterior of the casing which is to be cemented into place.

10 Claims, 4 Drawing Figures

WELL BORE CLEANING DEVICE

BACKGROUND OF THE INVENTION

This invention relates to the cementing of casing in an oil well, and more particularly to the cleaning of mud filter cake from the walls of the borehole during the cementing process.

An important part of the drilling and completing of an oil well is the process of primary casing cementing. This cementing is done immediately after the casing is placed in the hole. Primary cementing serves to separate and prevent migration of fluid between formations and between a formation and the surface, and to protect the casing pipe itself.

Mechanical aids have been developed to center the pipe in the hole, and to remove mud filter cake formed on the face of the formation. in order to assure a good bond between the casing and the formation. If the filter cake is not properly cleaned, the filter cake may contaminate and weaken the cement, or otherwise prevent a tight seal between the casing and the formation, thereby allowing formation fluid to leak into the annular area between the casing and the walls of the borehole and migrate from one formation to another, or from a formation to the surface.

Common cleaning devices developed to remove this filter cake are wire or cable scratchers which physically contact the wall of the hole and scrape or scratch the filter cake loose. They may be designed to be reciprocated or rotated. Examples of these type cleaners are illustrated in U.S. Pat. No. 3,842,906 to Paramore et al.

It has also long been known that if the cement slurry is kept in turbulent flow while mud is being displaced from the annulus, the turbulence itself will assist in removing filter cake. Thus the practices of high mud displacement velocity and movement of the casing during cementing have been developed to improve primary cementing.

Many devices have been developed to create the desired turbulence, such as those shown in U.S. Pat. Nos. 2,295,803; 3,072,195; and 3,196,952. Another such device is sold by the Weatherford Oil Tool Co., Inc. of 901 Chamber of Commerce Building, Houston, Texas, under the trademark "Hydro-Bonder." All of these devices create turbulence by causing a swirling action of the cement slurry against the wall of the borehole. However, these devices only sustain the turbulence over a limited length of the casing.

In many of these devices, scratchers or skirts extend to the wall of the borehole and are in contact with the wall as the casing is run in the hole. Such a configuration means that the cleaning device is subject to wear and damage as the casing is lowered into the hole, and thus the devices may have lost their effectiveness by the time the casing is completely run into the position where it is to be cemented.

Borehole washing devices have also been developed, such as that shown in U.S. Pat. No. 2,503,719, which are inflatable and force fins and spines into the walls of the borehole to take advantage of both scraping action and turbulence to assist in cleaning. These devices, however, are usually removed before the casing is run, thus allowing the filter cake to reform.

The present invention comprises a plurality of resilient cylinders fastened to a metal strap or band and dimensioned to cause Von Karman vortex trails on their downstream side when mud or cement slurry is moved past them. The cylinders are so spaced that when the strap is helically wound around the exterior of a casing, a random pattern is formed.

The cylinders only extend partially into the annulus region, and are resilient so that if they should make contact with the walls of the borehole they will be flexible enough to minimize damage to the device. Thus, the well bore cleaner will still be intact and effective when the casing is completely run in the hole.

Thus, a well bore cleaning device results which may be used with all sizes of well casings, and which creates or intensifies turbulence in the annular flow while mud is being displaced by a cement slurry in the annulus between the well casing and the walls of the borehole. This turbulence is caused by inducing alternately shedding vortices from each cylinder of a plurality of cylinders distributed in a random pattern over the outer periphery of the casing.

A cleaning device also results which is subject to a minimum of damage as the casing is run into the hole so that the device has not lost its effectiveness when the casing reaches its final location. The device additionally sustains the described turbulence over a large portion of the casing pipe because of the increased area over which the cylinders are distributed.

DESCRIPTION OF THE PREFERRED EMBODIMENT

Figure 1:
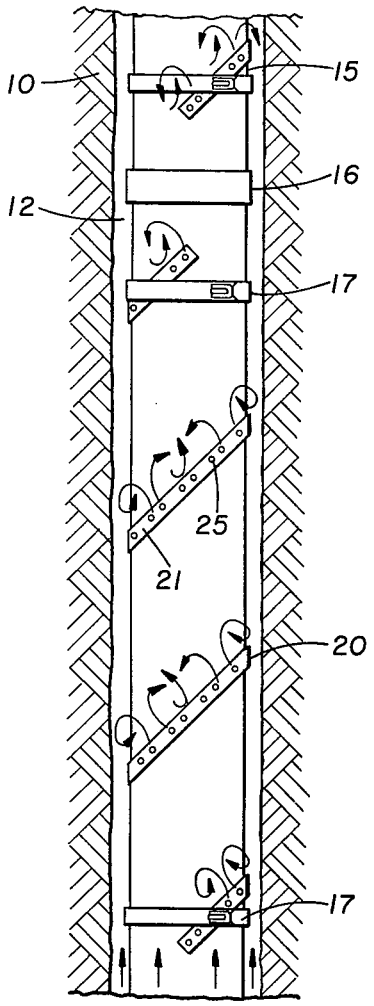
FIG. 1 presents a view of the cleaning device installed on a casing in position during the primary cementing process in a borehole.

FIG. 1 illustrates a formation 10 penetrated by a borehole 12 in which is placed a casing string 15 made up of individual casing sections joined together by casing collars 16. The casing string 15 is positioned in the center of the hole 12 by conventional centralizers (not shown).

The cleaning device 20 comprises a metal strap 21 helically wound around the casing string 15. The strap may be welded into place or may be secured with clamping devices 17 at each end of the strap 21 to hold the devices 20 in place. Suitable clamps are sold by Halliburton Services under the registered trademark "EZ LOK," and are shown on page 2425 of Halliburton Services Sales and Service Catalog Number 37.

Spaced along the strap 21 is a plurality of resilient cylinders 25. An advantageous location to place the cleaning device is in the vicinity of a casing collar 16 as shown. This location will allow the casing collar to give some protection to the cylinders 25 as the casing string 15 is run in the borehole 12.

Figure 3:
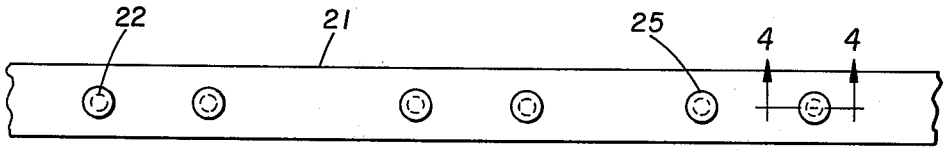
FIG. 3 presents a top view of a portion of the cleaning device.
Figure 2:
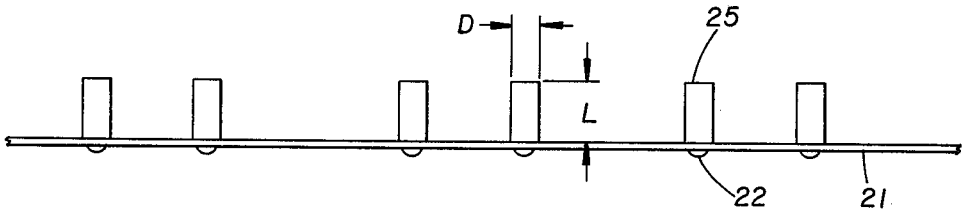
FIG. 2 presents a side view of a portion of the cleaning device illustrating the spacing and dimensions of the resilient cylinders.

FIGS. 2 and 3 illustrate the preferred spacing of the cylinders 25. The cylinders are fastened to the strap in pairs, with equal distances between the cylinders in the pair groups. The distance from the last cylinder of a pair to the first cylinder of the following pair is different than the distance between the individual cylinders of the pair as shown. This spacing results in random pattern of cylinders around the periphery of the casing when the strap 21 is helically wound around the casing string 15.

A typical center-to-center spacing of cylinders in a pair is 1.19 inches, while a typical center-to-center spacing of the last cylinder in a pair to the first cylinder in the following pair is 2.20 inches. It has been found that this will give the desired random pattern for the various sizes of the casing pipe if the distance between successive coils of the strap 21 is approximately equal to two diameters of the casing pipe.

Figure 4:
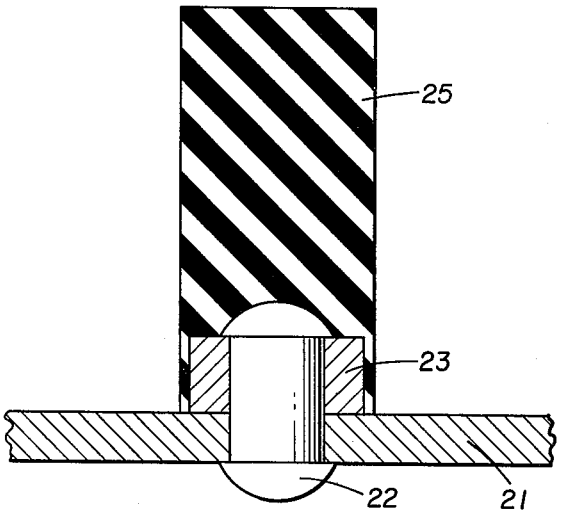
FIG. 4 presents a cross-sectional view of one of the resilient cylinders taken along section lines 4—4 in FIG. 3.

FIG. 4 is a cross-sectional view of one of the resilient cylinders 25. The preferred material is molded Buna rubber, although other material may be used which is flexible enough to minimize damage while the casing is being lowered into the well. The cylinders, however, must also be stiff enough to induce the desired vortex trails.

Embedded in the base of the cylinder 25 is a metal ring 23. Passing through the center hole of ring 23 and through a corresponding hole in the strap 21 is a rivet 22 which acts to fasten the cylinder 25 to the strap 21.

It is known that if the Renolds number is above a certain value, then the flow around a cylinder will result in a Von Karman vortex trail. The initiation of the desired vortex trail is also dependent upon the dimensions of the cylinders. It has been found that the desired vortex trail can be set up for a primary cementing operation in an oil well when the length L of the cylinder 25 is approximately two to five times the diameter D of the cylinders. A typical length L is 0.656 inches, while a typical value of the diameter D is 0.312 inches.

In a typical primary cementing operation, the casing string 15 is run into the mud filled borehole 12 with appropriate centralizers and borehole cleaning devices 20 in place. Conventional wire or cable type scratchers could also be used if desired to scrape the formation 10 as the casing 15 is lowered into place. Cement is then pumped down the center of the casing string and directed into the annulus in the usual manner, thereby displacing the mud in the annulus. If possible, the cement is pumped at a flow rate sufficient to keep the mud displaced from the annulus and the displacing cement in turbulent flow to prevent channeling, and to effect the removal of the maximum amount of mud.

Thus, as the mud and later the cement moves through the annulus, it will desirably be in turbulent flow. As it moves past the bore cleaning device, the cylinders will induce vortex trails into the flow, thus intensifying the turbulence of the flow to effect a more complete removal of the filter cake on the walls of the borehole.

Although a specific preferred embodiment of the present invention has been disclosed in the description above, the description is not intended to limit the invention to the particular form disclosed. For instance, a molded rubber cylinder might be used having a T-shaped cross-section and inserted through the holes in strap 21 from the back such that the T-portion of the cylinder is held in place between the casing string and the strap, rather than by the fastening means shown. Those skilled in the art, and familiar with the present disclosure may envision additions, deletions, substitutions, or other modifications or alterations which would fail within the scope of the invention as set forth in the appended claims.

What is claimed is:

1. An apparatus for use in an oil well for creating turbulence in a slurry flowing in an annulus between an oil well casing and the wall of the well bore, comprising:

a strap for being helically wound around and attached to the exterior of said well casing; and, a plurality of cylindrical means fastened to said strap for extending radially outwardly and sized to extend partially into the annulus without making contact with the wall of the well bore when the casing is centered therein, said plurality of cylindrical means being spaced on said strap to provide a random pattern of said cylindrical means on the exterior of said well casing whereby cleaning of the wall of the well bore is effected by vortex trails induced in said slurry by said randomly positioned cylindrical means.

2. The apparatus of claim 1 wherein said plurality of cylindrical means are fastened to said strap linearly along the length of said strap with each one of said cylindrical means spaced a distance from the cylindrical means immediately following said one cylindrical means at a distance which is different from the distance to the cylindrical means which immediately precedes said one cylindrical means such that said plurality of cylindrical means form a random pattern around the periphery of said well casing when said strap is helically wound around said well casing.

3. The apparatus of claim 2 wherein the length of each of said cylindrical means is greater than about two times the diameter of said cylindrical means, and less than about five times the diameter of said cylindrical means.

4. The apparatus of claim 1 wherein each cylindrical means of said plurality of cylindrical means comprises:

a molded rubber cylinder;

a metal ring embedded in the base of said rubber cylinder; and, a metal rivet passing through said metal ring for fastening said rubber cylinder to said strap.

5. An apparatus for cleaning mud filter cake from the well bore of an oil well responsive to a slurry flowing in an annulus between an oil well casing and the wall of the well bore, comprising:

a strap helically wound around the exterior of the well casing;

securing means for securing said strap to said oil well casing; and, a plurality of cylindrical means fastened along the length of said strap and sized to extend partially into the annulus without making contact with the walls of the well bore, said plurality of cylindrical means being spaced on said strap to provide a random pattern of said cylindrical means around the periphery of a portion of said oil well casing, thereby cleaning mud filter cake from the walls of the well bore by the action of vortex trails induced in said slurry by said cylindrical means.

6. The apparatus of claim 5 wherein the length of each of said cylindrical means is greater than about two times the diameter of said cylindrical means, and less than about five times the diameter of said cylindrical means.

7. The apparatus of claim 6 wherein said plurality of cylindrical means are grouped in pairs, with the distance between successive pairs of cylindrical means being different than the distance between the individual cylindrical means of each pair.

8. The apparatus of claim 7 wherein the distance between successive coils of said helically wound strap is about twice the outside diameter of the oil well casing.

9. The apparatus of claim 8 wherein each of said cylindrical means of said plurality of cylindrical means comprises:

a molded rubber cylinder;

a metal ring embedded in the base of said rubber cylinder; and, a metal rivet passing through said metal ring and said strap for fastening said rubber cylinder to said strap.

10. A well bore cleaning device comprising:

a strap; and a plurality of cylindrical means fastened to said strap wherein each of said cylindrical means include;

a molded rubber cylinder selectively sized to extend partially into the well bore from the strap without making contact with the walls of the well bore, a metal ring embedded in the base of said rubber cylinder, and a metal rivet passing through said metal ring for fastening said rubber cylinder to said strap.

* * * * *